United States Patent [19]

Brandon

[11] Patent Number: 5,049,032

[45] Date of Patent: Sep. 17, 1991

[54] PARTICULATE SEAL FOR ELASTIC FLUID TURBINES

[76] Inventor: Ronald E. Brandon, 1734 Lenox Rd., Schenectady, N.Y. 12308

[21] Appl. No.: 516,803

[22] Filed: Apr. 30, 1990

[51] Int. Cl.[5] ..... F01D 11/00; F16J 15/00

[52] U.S. Cl. ..... 415/170.1; 415/173.7; 415/174.2; 277/53; 277/205; 277/206 R; 277/DIG. 6

[58] Field of Search ..... 415/170.1, 173.1, 173.6, 415/173.7, 174.2; 277/53, 55, 152, 56, 205, 206 R

[56] References Cited

U.S. PATENT DOCUMENTS

| | | | |
|---|---|---|---|
| 2,461,243 | 2/1949 | Soderberg | 277/56 |
| 3,501,246 | 3/1970 | Hickey | 415/173.7 |
| 3,829,233 | 6/1973 | Scalzo et al. | 277/53 |
| 3,897,169 | 4/1973 | Fowler | 415/173.6 |
| 4,989,886 | 3/1989 | Rulis | 277/53 |

*Primary Examiner*—Edward K. Look
*Assistant Examiner*—Michael S. Lee
*Attorney, Agent, or Firm*—Ross, Ross & Flavin

[57] ABSTRACT

Stationary particulate seals are provided for elastic fluid turbines to minimize the influx of weld beads and other particulate material into critical zones of stationary diaphragms including the horizontal joint and the axial seal ledge where the diaphragm and shell contact each other.

15 Claims, 3 Drawing Sheets

PARTICULATE SEAL FOR ELASTIC FLUID TURBINES

BACKGROUND OF THE INVENTION

1. Field of the Invention

Steam turbines must cope with particulate material which passes through the stages and is capable of causing considerable harm. Particulate material can originate outside the turbine, such as boiler tube scale or weld beads and slag, or it can result from loose turbine pieces therewithin.

Such material can cause impaired turbine performance when permitted to penetrate into the horizontal Joints of diaphragms and shells or into the seal surfaces between diaphragms and shells. Such penetration is frequently found in turbines. It results primarily from the centrifugal effects of the whirling steam and rotating buckets which causes the particulate material to be thrown into the space between the diaphragm outer rings and the shells.

Such material can cause damage to nozzles and buckets as it passes through the turbine stages.

2. Description of Related Art

Turbine designers have not provided a significant protection system to minimize such damage. While manufacturers have provided protection for nozzles and bucket surfaces, little or nothing has been done to protect the components to which this invention is directed.

SUMMARY OF THE INVENTION

One object of the invention is to prevent the entrance of particulate material into the annular space between the turbine diaphragm outer rings and shells.

Another object is to prevent excess leakage in the turbine stage. Still another object is the prevention of erosion.

The invention is practiced by providing simple seals that provide a barrier to minimize the passage of particulate material into the space outside of steam turbine diaphragms and inside the supporting shells. In its best form, the seals are capable of conforming to the shape of the nominally round surfaces of diaphragms and shells, recognizing that both temporary and permanent distortion must be expected.

According to the invention, stationary particulate seals are provided for elastic fluid turbines to minimize the influx of weld beads and other particulate material into critical zones of stationary diaphragms including the horizontal Joint and the axial seal ledge where the diaphragm and shell contact each other.

BRIEF DESCRIPTION OF THE DRAWINGS

For a better understanding of the invention, reference is made of the accompanying drawings in which.

DESCRIPTION OF THE PREFERRED EMBODIMENT

Figure 1:
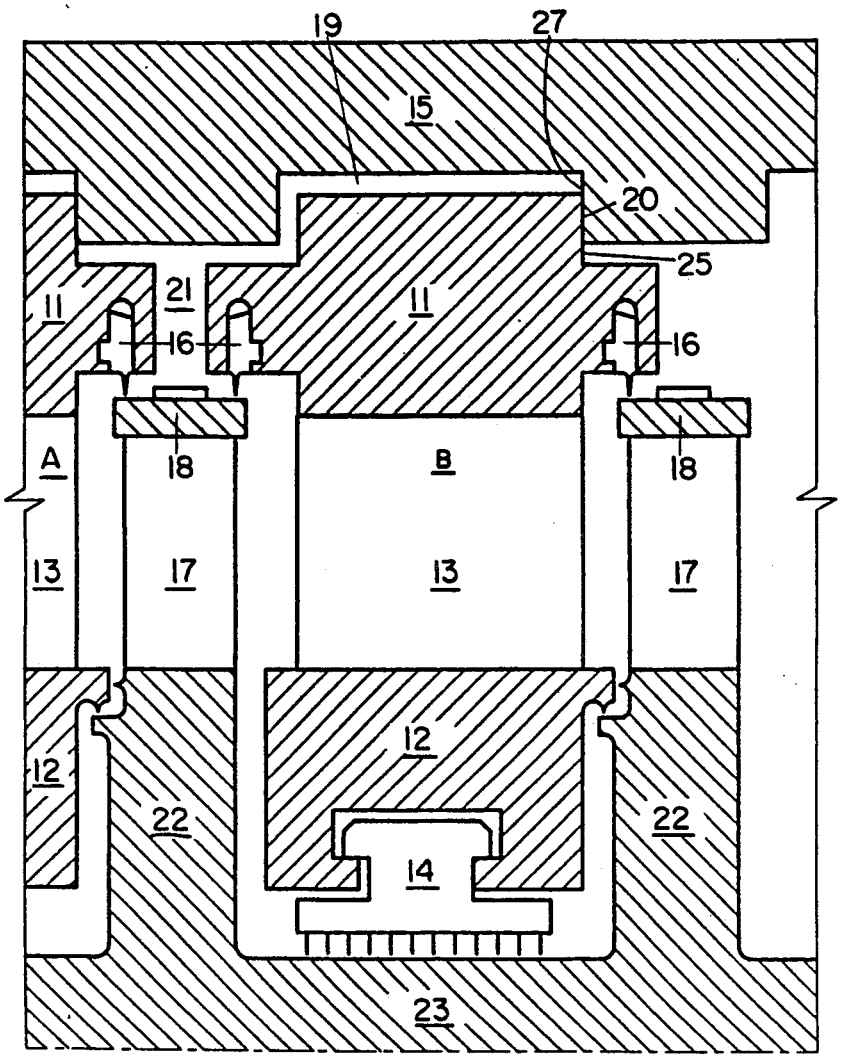
FIG. 1. PRIOR ART
FIG. 1 is a horizontal cross-sectional view of a typical prior art multistage axial flow elastic turbine showing one stage and a portion of another.
Figure 2:
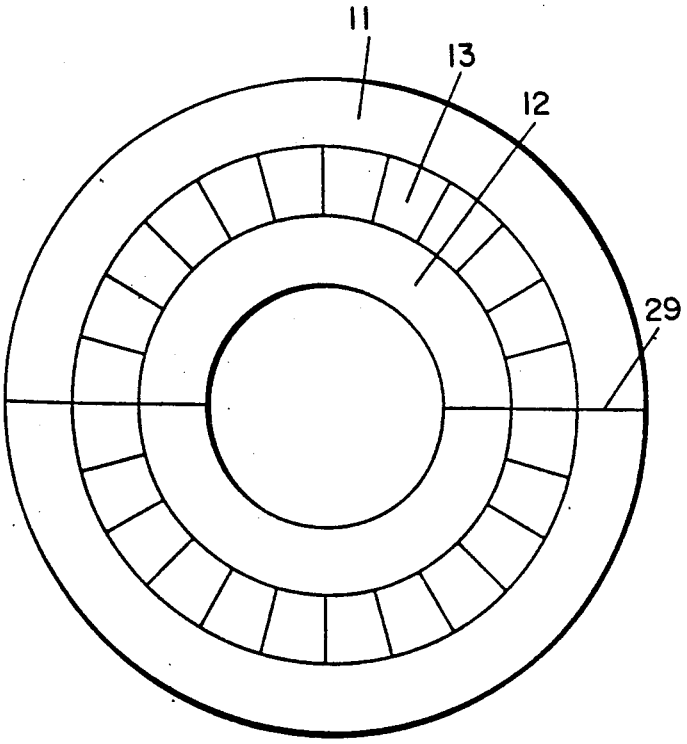
FIG. 2 is an end view of a typical prior art turbine diaphragm.

Referring to FIGS. 1 and 2, a turbine of the prior art includes a rotor 23, with wheels 22 and buckets 17, the buckets having covers 18 fitted on their outer ends.

The rotor, wheels and buckets turn at high speed, with torque being provided by steam which has been accelerated to a high tangential velocity by passage through a circle of nozzles 13.

The nozzles are held in a diaphragm comprised of two annular components, namely, an outer ring 11 and an inner ring 12.

Tip seals 16 extend between diaphragm outer rings 11 and bucket covers 18.

A shaft seal 14 extends between diaphragm inner ring 12 and rotor 23.

The diaphragms are constructed of two matching halves which meet at a horizontal Joint 29 to simplify assembly and disassembly.

The diaphragms and rotor are enclosed in a shell 15 which supports and locates the diaphragms and helps to contain the elastic fluid.

It should be noted that tip seals 16 may be held in shell 15 rather than diaphragm outer ring 11. The seals may also be held on rotor 23 or shroud and rotate therewith.

In operation, high pressure elastic fluid expands through stages A and B, entering stage A from the left as seen in FIG. 1 and passing through the nozzles 13 and then the buckets 17. As the fluid passes through the nozzles, its pressure drops and the tangential velocity is greatly increased. As the fluid passes through the rotating buckets 17, the tangential momentum of the fluid is removed and torque is provided to rotor 23.

Three seals are important to good performance. The shaft seal 14 minimizes leakage that bypasses nozzles 13. The tip seals 16 minimize leakage that bypasses buckets 17. A third seal is provided at the contact surface or axial seal ledge 20, formed by a shoulder 25 of diaphragm outer ring 11 making bearing contact with a shoulder 27 of shell 15. Undesirable leakage at this location would bypass the entire stage.

In addition, horizontal joint 29 is expected to provide a metal-to-metal seal to prevent leakage that would also be harmful to stage efficiency.

For turbine stages where particulate material is included in the fluid, there is a strong tendency for the particles to be centrifuged to the outside with a high probability of being thrown into spaces 21 between adjacent diaphragm outer rings 11 and into spaces 19 between diaphragm outer rings 11 and shell 15. When this occurs it is common to find that the particles can work into the horizontal joints of both the diaphragm outer ring and the shell, also causing leakage.

Figure 3:
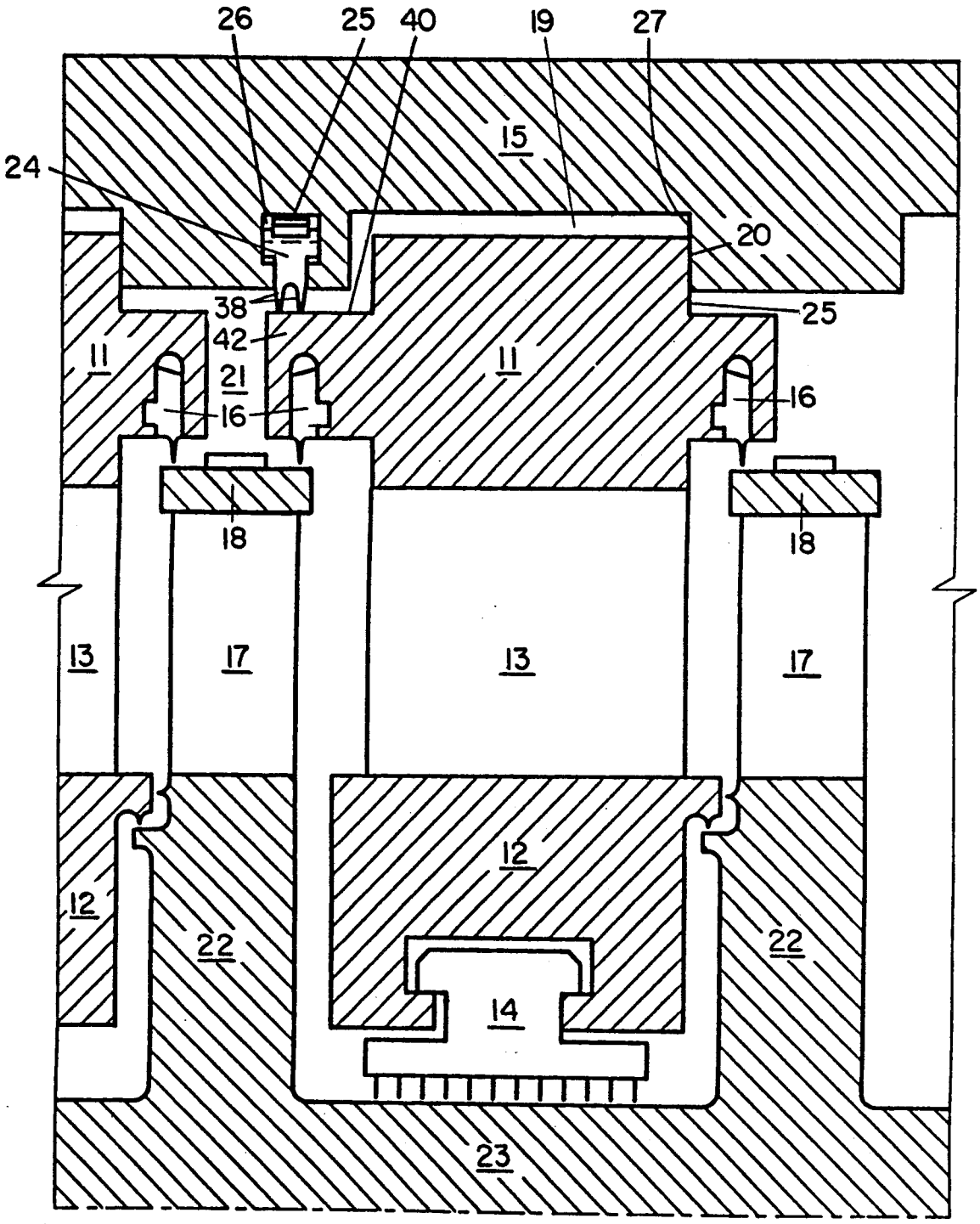
FIG. 3 is a cross-sectional view similar to FIG. 1 and incorporating the particulate seal of the invention.
Figure 4:
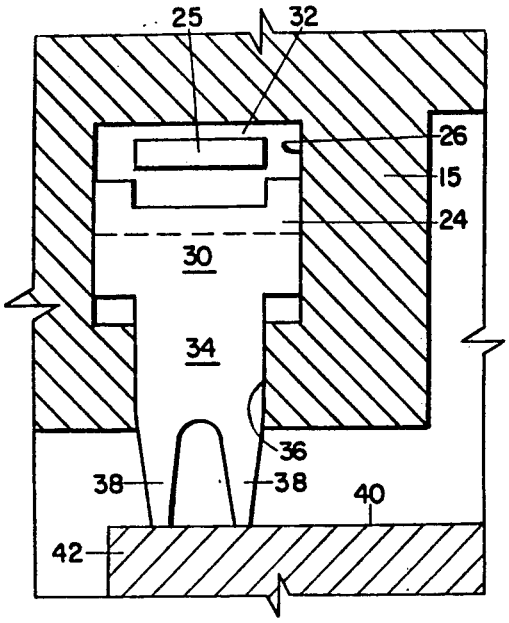
FIG. 4 is an enlarged, fragmentary cross-sectional view of the particulate seal of FIG. 3.

As shown in FIGS. 3 and 4, an annular particulate seal 24, embodying one form of the invention, is added to prevent the undesirable leakage and erosion identified above.

Seal 24 is preferably formed from 400 series stainless steel. However, a wide variety of steels may be considered. Seal 24 is comprised of multiple arcuate segments which are installed in an annular T-shaped groove 26 in shell 15 and include an upper body portion 30 disposed in a horizontally-disposed upper portion 32 of groove 26 and a lower body portion 34 disposed in a vertically-disposed lower portion 36 of groove 26.

Lower body portion 34 of particular seal 24 terminates in a bifurcated lower end which defines a pair of spaced teeth 38 which extend downwardly and outwardly from shell 15 and bear on an upper face 40 of a shoulder 42 of diaphragm outer ring 11.

Shell groove 26 permits minor radial motion of seal 24 to permit conformance of the seal to slight temporary or permanent distortion of diaphragm 11 or shell 15.

Springs 25 installed in upper portion 32 of groove 26 are adapted to bear on the seal upper body portion 30 to insure contact of teeth 38 of the seal with upper face 40 of shoulder 42 of diaphragm outer ring 11.

It should be noted that a variety of alternate arrangements can also be effective.

Figure 5:
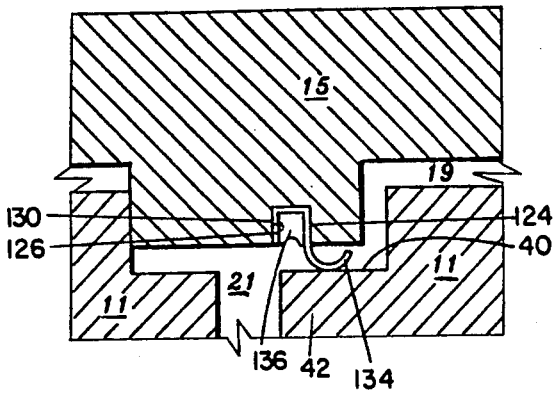
FIGS. 5–7 are fragmentary cross-sectional views of modified forms of the particulate seal of the invention.

As shown in FIG. 5, an annular particulate seal 124, embodying a first modified form of the invention, includes an inverted U-shaped upper portion 130 rigidly mounted in a complemental groove 126 in shell 15 and having an integral curved thin, flexible lower tooth portion 134 which extends downwardly from shell 15 and bears on upper face 40 of shoulder 42 of diaphragm outer ring 11.

A caulking strip 136 serves to hold seal 124 in place in groove 126. The caulking strip may be formed from materials such as steel or steel alloys, the use being determined by the thermal condition of the application.

The thin, flexible tooth portion 134 of seal 124 insures proper contact between seal and diaphragm without a separate spring.

Figure 6:
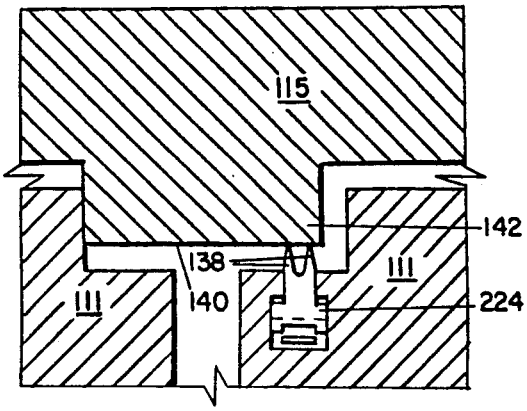

In another modified form of the invention shown in FIG. 6, a particulate seal 224 is mounted on a diaphragm outer ring 111 rather than on a shell 115 with teeth 138 of the seal bearing on a face 140 of a shoulder 142 of shell 115. Seal 224 can also be placed in a axial configuration, either mounted on shell 115 or diaphragm outer ring 111.

Regardless of the form of particulate seal used, the whirling particulate material will have a tendency to erode or abraid the teeth of the seal.

Multiple or thick teeth on the seal will help slow such damage.

Figure 7:
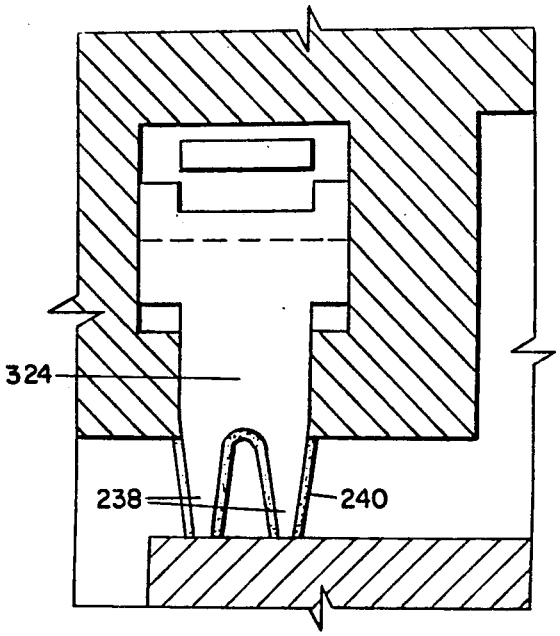
Figure 8:
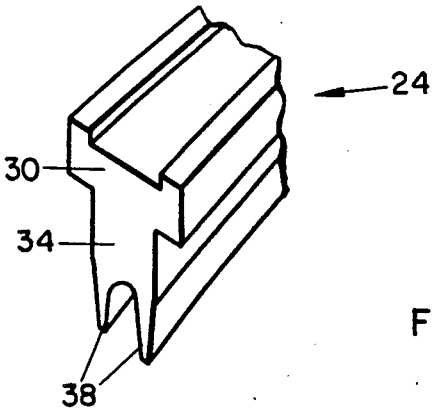
FIG. 8 is a fragmentary perspective view of the particulate seal of FIGS. 3 and 4.

In addition, and as shown in still another modified form of the invention in FIG. 7, a protective layer of hardened material 240, such as titanium nitride and other proven protective coatings such as aluminia and titanium carbide is placed on the outer surfaces of teeth 238 of a particulate seal 324 to further diminish the harmful effects of the whirling particulate material. The protective layer of hardened material 240 may be created by welding, metal spraying, exposure to hardening agents including flame or any method that creates the desired level of hardening without introducing a threat of cracking, spauling or other metal failure that would endanger adjacent or downstream turbine components.

Various other modifications of the invention will occur to those skilled in the steam turbine disciplines. It is desired to secure by the appended claims, all such modifications that may fall within the true spirit and scope of the invention.

I claim:

1. An elastic fluid turbine having a rotor with attached wheels and buckets adapted to be rotated at high speeds with torque provided by elastic fluid which has been accelerated to a high tangential velocity by passage through a circle of nozzles held in diaphragms enclosed in a shell which supports and locates the diaphragms and helps to contain the elastic fluid and wherein, in operation, high pressure elastic fluid expands and passes through the nozzles and buckets, with the pressure of the elastic fluid dropping as it passes through the nozzles while its tangential velocity is greatly increased, there being open spaces between adjacent diaphragms and an open space between diaphragms and the shell, the improvement which comprises particulate seals interposed between the diaphragms and the shell for precluding the influx of particulate material or contaminants present in the elastic fluid into said open spaces.

2. An elastic fluid turbine according to claim 1, wherein the particulate seals are formed from steel.

3. An elastic fluid turbine according to claim 1, wherein the particulate seals are formed from 400 series stainless steel.

4. An elastic fluid turbine according to claim 1, wherein the particulate seals are disposed in grooves in the shell and extend into the open spaces and contact the diaphragms.

5. An elastic fluid turbine according to claim 4, wherein the particulate seals are spring-loaded.

6. An elastic fluid turbine according to claim 1, wherein the particulate seals are disposed in grooves in the shell and have fingers which extend into the open spaces and contact the diaphragms.

7. An elastic fluid turbine according to claim 1, wherein the particulate seals are fixed in a groove in the shell and have an arcuate finger which extends into the open spaces and contacts the diaphragms.

8. An elastic fluid turbine according to claim 7, including a caulking strip for holding the particulate seals in the groove in the shell.

9. An elastic fluid turbine according to claim 8, wherein the caulking strip is formed from steel.

10. An elastic fluid turbine according to claim 8, wherein the caulking strip is formed from steel alloys.

11. An elastic fluid turbine according to claim 1, wherein the particulate seals are disposed in grooves in the diaphragms and extend into the open spaces and contact the shell.

12. An elastic fluid turbine according to claim 1, including a protective layer of hardened material on the particulate seals.

13. An elastic fluid turbine according to claim 12, wherein the protective layer of hardened material on the particulate seals is titanium nitride.

14. An elastic fluid turbine according to claim 12, wherein the protective layer of hardened material on the particulate seals is aluminia carbide.

15. An elastic fluid turbine according to claim 12, wherein the protective layer of hardened material on the particulate seals is titanium carbide.

* * * * *